US008428797B2

(12) United States Patent
Rosenkranz et al.

(10) Patent No.: US 8,428,797 B2
(45) Date of Patent: Apr. 23, 2013

(54) METHOD AND ARRANGEMENT FOR THE OPERATION OF A RAILROAD LINE

(75) Inventors: Uwe Rosenkranz, Braunschweig (DE); Klaus Scharnweber, Cremlingen (DE)

(73) Assignee: Siemens Aktiengesellschaft, Munich (DE)

( * ) Notice: Subject to any disclaimer, the term of this patent is extended or adjusted under 35 U.S.C. 154(b) by 661 days.

(21) Appl. No.: 12/667,176

(22) PCT Filed: Jun. 17, 2008

(86) PCT No.: PCT/EP2008/057611

§ 371 (c)(1),
(2), (4) Date: Dec. 29, 2009

(87) PCT Pub. No.: WO2009/003837

PCT Pub. Date: Jan. 8, 2009

(65) Prior Publication Data

US 2010/0191395 A1 Jul. 29, 2010

(30) Foreign Application Priority Data

Jun. 29, 2007 (DE) ..... 10 2007 031 138

(51) Int. Cl.
*G05D 1/00* (2006.01)

(52) U.S. Cl.
USPC ..... 701/19; 246/3; 246/59; 246/166.1

(58) Field of Classification Search ..... 701/19, 701/20; 246/3, 59, 122 R, 166.1
See application file for complete search history.

(56) References Cited

U.S. PATENT DOCUMENTS

| | | | | |
|---|---|---|---|---|
| 4,768,740 | A | 9/1988 | Corrie | |
| 4,858,859 | A | 8/1989 | Apperson | |
| 5,340,062 | A * | 8/1994 | Heggestad | 246/5 |
| 5,398,894 | A * | 3/1995 | Pascoe | 246/28 R |
| 5,533,695 | A * | 7/1996 | Heggestad et al. | 246/62 |
| 5,823,481 | A * | 10/1998 | Gottschlich | 246/28 R |
| 2003/0222180 | A1 | 12/2003 | Hart et al. | |
| 2004/0267415 | A1 | 12/2004 | Lacote et al. | |

FOREIGN PATENT DOCUMENTS

| | | | |
|---|---|---|---|
| DE | 3337183 | A1 | 4/1985 |
| DE | 4420215 | A1 | 12/1995 |
| DE | 19630575 | A1 | 2/1998 |
| DE | 19843230 | A1 | 4/2000 |
| EP | 1366967 | A2 | 12/2003 |
| EP | 1498338 | A1 | 1/2005 |
| EP | 1769996 | A2 | 4/2007 |
| GB | 2218557 | A | 11/1989 |

* cited by examiner

*Primary Examiner* — Gertrude Arthur Jeanglaude
(74) *Attorney, Agent, or Firm* — Laurence A. Greenberg; Werner H. Stemer; Ralph E. Locher

(57) ABSTRACT

A method and a configuration for the operation of a railroad line include at least one signal box for providing line-block-section-specific light signal data and a line side system for an intermittent automatic or inductive train control system at line block section ends. In order to dispense with line side light signals and still be able to continue to use a signal box logic concept for light signals, the signal box transfers the line-block-section-specific light signal data over a radio system to a rail vehicle and the intermittent automatic or inductive train control system transfers line-block-section-specific data to the rail vehicle during passage by the rail vehicle. The rail vehicle determines the light signal data assigned to the line block section by comparison of line block section specifics.

5 Claims, 2 Drawing Sheets

METHOD AND ARRANGEMENT FOR THE OPERATION OF A RAILROAD LINE

BACKGROUND OF THE INVENTION

Field of the Invention

The invention relates to a method for operation of a railroad line having at least one signal box for line-block-section-specific presetting of light signal information items, and having a line side system for intermittent automatic train control at the line block section ends, and to an arrangement for carrying out the method.

By way of example, an arrangement of this generic type is known from DE 44 20 215 A1 and from DE 198 43 230 A1. In this case, intermittent automatic train control is provided in order to transmit information items, in particular identifications, of subsequent signaling devices. The signaling devices comprise line conductor loops and signal devices which transmit a signal reference which is predetermined by the signal box. These arrangements require the presence of light signals at each line block section end. In order to operate the light signals, the signal box is equipped with signal box logic that is designed for light signals.

Arrangements are also known without light signals, wherein the signal reference information items are provided either by continuous cab control with speed code systems, in which the information items are transmitted via the rails to the rail vehicles, or by line conductor loop systems. In these arrangements, special signaling logic which is suitable for continuous cab control is required in the signal boxes, in order to monitor the vehicle movements on the line network.

BRIEF SUMMARY OF THE INVENTION

The invention is based on the object of specifying a method for operation of a railroad line, and a corresponding arrangement of this generic type, which allow the reuse of the signal box logic which is designed for light signals without any line side light signals.

With regard to the method, the object is achieved in that the signal box transmits the line-block-section-specific light signal information items via a radio system to a rail vehicle, and in that the intermittent automatic train control system transmits line-section-specific data items to the rail vehicle when the rail vehicle travels over it, wherein the rail vehicle determines the light signal information items associated with the line block section by comparison of the line block section specifics.

An arrangement according to the invention for carrying out the method is equipped in the signal box with means for the formation of radio messages, which comprise line-block-section-specific data items and associated light signal information items, and is equipped in the rail vehicle with radio receivers for reception of the radio messages, wherein the rail vehicle has comparison means for determining the current light signal information items on the basis of a comparison of the line-block-section-specific data items in the radio messages with line-block-section-specific data items which are transmitted to the rail vehicle from the intermittent automatic train control system, as the rail vehicle travels over them.

Line side light signals are in this way finally replaced by radio signal information items. The signal box logic which is designed for line side light signals can be retained in this case. The intermittent automatic train control is in this case now used only to transmit the line-block-section-specific data items, preferably a line-block-section number of a line block section that has not yet been reached. The message configuration data items and the signal box components relating to them can also be accepted by the known drive for the automatic train control system. The radio system results in a considerable reduction in the amount of copper wiring at the line side, since there is no longer any need for line conductor loops along the line.

According to the invention, the intermittent automatic train control system is equipped with fixed-coded line side coupling coils and/or beacons, wherein the fixed coding comprises the line-block-section-specific data items. In known systems of modern design using the ETCS (European Train Control System) specification, switchable beacons are predominantly used for transmission of changing information items from the signal box to the line. According to the invention, there is no need whatsoever for the beacon control or for a drive for track coupling coils. The data points, specifically in particular track coupling coils or beacons, just have to be designed for safe signaling, wherein the same information content, specifically preferably the number of the next line block section, is always transmitted.

According to the invention, the signal box is connected via a radio coupling computer and a radio bus system to radio transmitters arranged along the railroad line. The radio transmitters are preferably equipped with directional antennas which transmit the light signal information items in the opposite direction to the direction of travel.

According to the invention, the rail-vehicle comparison means comprise a radio computer, whose signaling is not safe, and which is connected to a vehicle computer, whose signaling is safe, in the intermittent automatic train control system. In this way, the vehicle computer, whose signaling is safe, and which is normally present is largely free from carrying out any additional tasks. The comparison, that is to say the elimination of the light signal information items which are not intended for the line block section, is carried out by the radio computer, whose signaling is not safe. Only the radio message with the light signal information items whose line block section number matches the line block section number of the line block section ahead, as received by the vehicle computer, is transmitted to the vehicle computer, where its correctness is checked by means of known security methods. Correct light signal information items are used for the journey ahead, wherein the journey is monitored with safe signaling by the vehicle computer.

According to the invention, the radio coupling computer in the signal box, the radio bus system and the radio receiver in the rail vehicle as well as the radio computer are of redundant design. This results in increased availability of the light signal information items. If the radio transmitters are additionally equipped with two directional antennas, which transmit data messages forwards and backwards, both directions of travel on a double-line section can be supplied with light signal information items. However, the redundancy concept can also be restricted as appropriate for the safety requirements to some of the components, and/or may comprise other components.

In one preferred embodiment according to the invention, the radio computer in the rail vehicle is connected to a device for automatic operation ATO—Automatic Train Operation. Both the line-section-specific data items and the light signal information items are concentrated in the radio computer for correct comparison, as a result of which interaction with an ATO function is simplified by means of appropriate inputs and outputs. A further advantage in this case is the restriction to a minimalistic line technology, specifically only intermittent automatic train control with fixed-coded data points.

BRIEF DESCRIPTION OF THE SEVERAL VIEWS OF THE DRAWING

The invention will be explained in more detail in the following text with reference to illustrations in the figures, in which.

DESCRIPTION OF THE INVENTION

Figure 1:
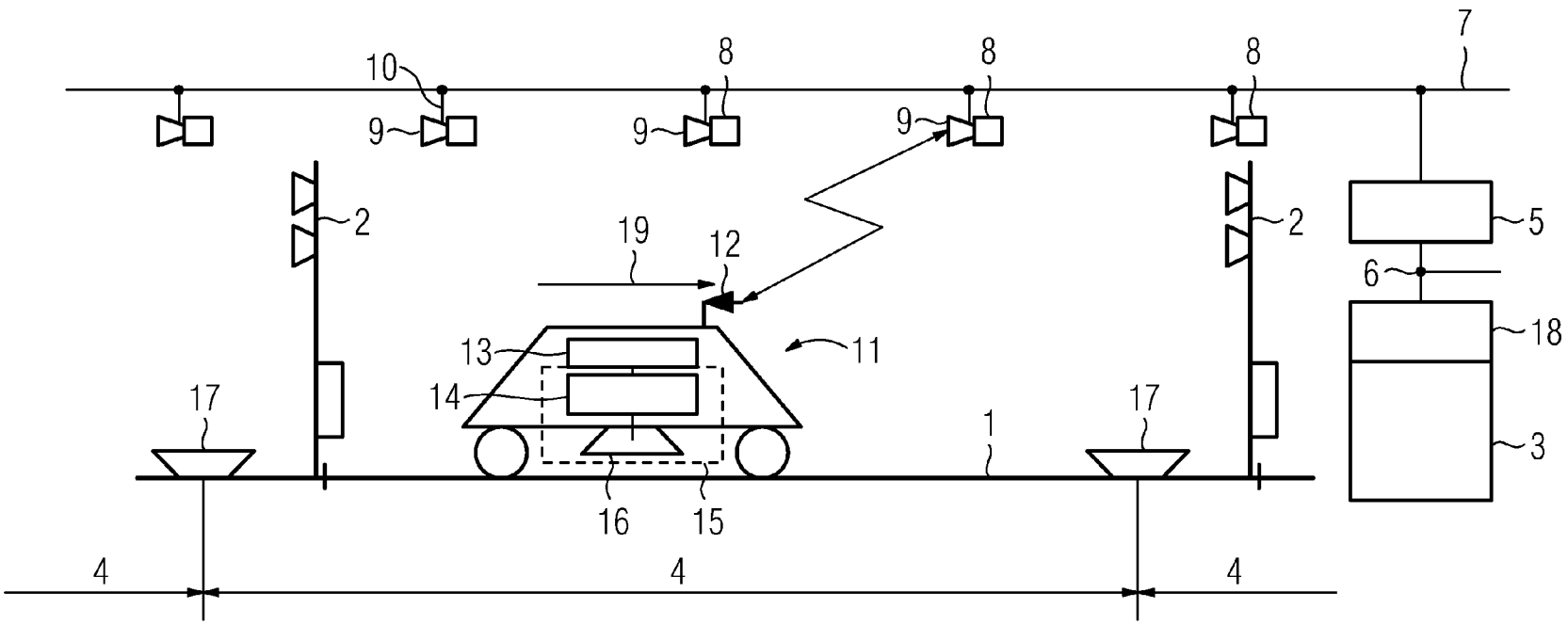
FIG. 1 shows a first embodiment of an arrangement according to the invention.

FIG. 1 illustrates a detail of a railroad line 1 with virtual light signals 2, that is to say light signals 2 which are physically not present. Instead of the light signals 2, a radio system is installed along the railroad line 1 from an electronic signal box 3 to line block sections 4. The radio system comprises a radio coupling computer 5 which is connected to the signal box 3 via a signal box bus 6 which connects all the signal boxes 3, as well as a radio bus system 7, to which radio transmitters 8 are connected. The radio transmitters 8 transmit radio messages by means of directional antennas 9 which are oriented in the opposite direction to the direction of travel, and the radio messages contain line block section numbers and associated light signal information items. The radio transmitters 8 are connected to the radio bus system 7 via bus interfaces 10. The radio messages transmitted by the directional antennas 9 are received by rail vehicles 11 located in the vicinity, by means of radio receivers 12 at the end. The radio receiver 12 is connected to a radio computer 13, whose signaling is not safe and that interacts with a vehicle computer 14, whose signaling is safe. The radio computer 14 is part of a device 15 in the vehicle for intermittent automatic train control, and which also has train coupling coils 16. Each line block section 4 is provided with a fixed-coded coupling coil 17 in a fixed position. In addition to possibly transmitting further data items, the coupling coil 17 transmits the number of the next line block section to the rail vehicle 11 travelling over it.

The signal information items, which represent a signal reference, are created in the signal box 3 as appropriate for the respective traffic situation, and are emitted to a control and display interface 18, whose signaling is safe, in order to operate the signal box control interface. In addition, the control and display interface 18 is used to generate data messages with the line-block-section-specific line signal information items. In addition to the line block section number and the associated signal reference, these data messages contain an indication of their actual timing, for example the time of day or ring counter state, and a protection attachment for protection against corruption during transmission. The data messages are transmitted via the radio coupling computer 5, the radio bus system 7 and the radio transmitters 8 to the radio receivers 12, and therefore to the radio computers 13 in the rail vehicles 11. At the same time, the vehicle computer 14 transmits the applicable line block section number to the radio computer 13. The radio computer 13 is therefore able to evaluate the received data messages for the number, received by the vehicle computer 14, of the line block section ahead, by comparison with the number contained in the data message. The data message that is filtered out in this way is passed to the vehicle computer 14, which checks the information items contained therein and whose signal is safe from the signal box 3 for authenticity, current validity and integrity, on the basis of safe signaling. If they are correct, the light signal information items are used to continue the journey.

Figure 2:
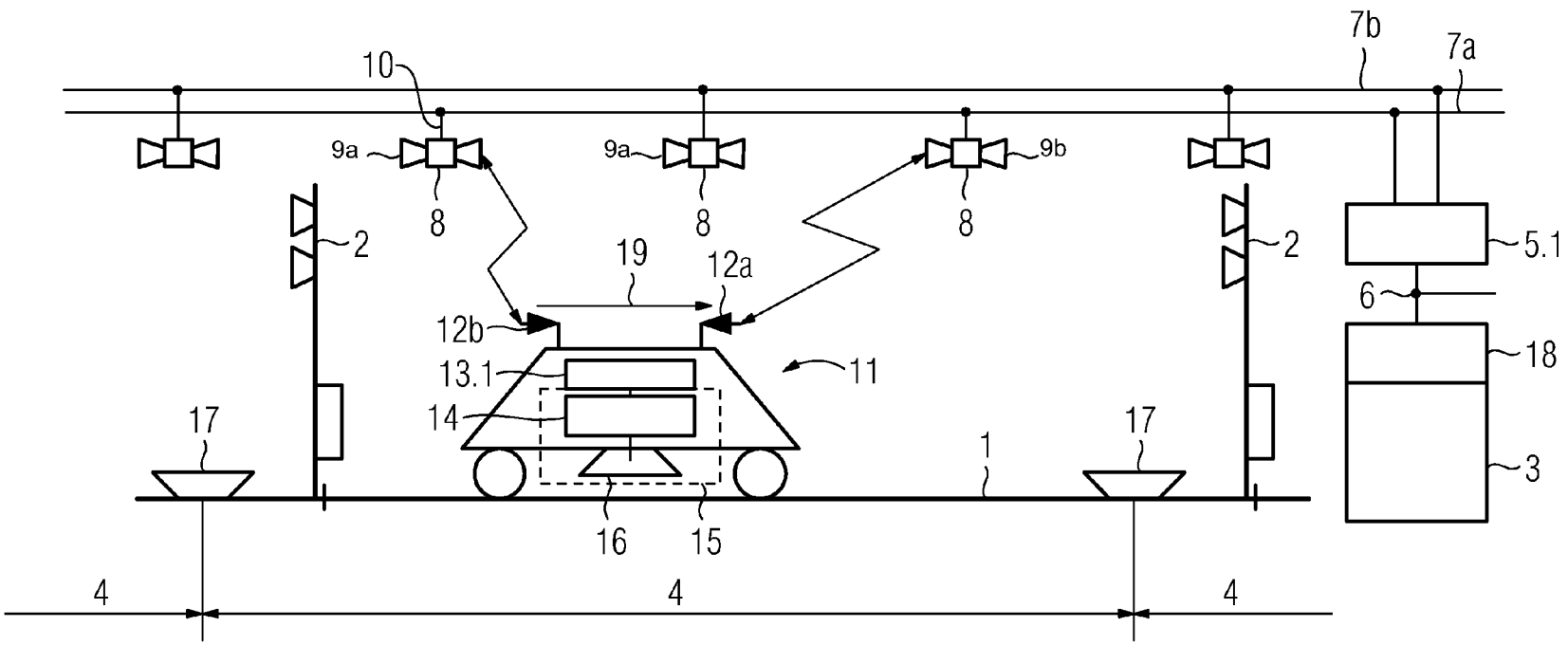
FIG. 2 shows a second embodiment of an arrangement according to the invention.

The embodiment illustrated in FIG. 2 differs from the embodiment shown in FIG. 1 by an additional redundant embodiment of the radio coupling computer 5.1, of the radio bus system 7*a* and 7*b*, of the radio receivers 12*a* and 12*b* in the rail vehicle, and of the radio computer 13.1. Two data messages with the light signal information items filtered out are therefore transmitted to the vehicle computer 14 whose signaling is safe, thus resulting overall in increased availability of the overall installation.

The radio transmitter 8 is equipped with two directional antennas 9*a* and 9*b*, which transmit data messages in the direction of travel 19 and in the opposite direction to the direction of travel 19. Both directions of travel on a double-line section can thus be controlled by a single radio system.

The radio computer 13 in the rail vehicle, as shown in FIG. 1, or 13.1 as shown in FIG. 2, may furthermore, and in a further function, provide inputs and outputs for automatic operation ATO—Automatic Train Operation—in conjunction with the data messages received by the radio system and position information items received on the line side from the intermittent automatic train control.

The invention claimed is:

1. A configuration for operation of a railroad line, the configuration comprising:

at least one signal box configured to preset line-block-section-specific light signal information items, said at least one signal box forming radio messages including line-block-section-specific data and associated light signal information items;

a line side intermittent automatic train control system disposed at line block section ends and having a vehicle computer with signaling which is safe;

a rail vehicle having rail-vehicle radio receivers configured to receive the radio messages; and said rail vehicle having a comparison device configured to determine current light signal information items based on a comparison of the line-block-section-specific data items in the radio messages with line-block-section-specific data items transmitted to said rail vehicle from said intermittent automatic train control system as said rail vehicle passes, said rail-vehicle comparison device having a radio computer with signaling which is not safe, being connected to said vehicle computer.

2. The configuration according to claim 1, wherein said intermittent automatic train control system has at least one of fixed-coded line side coupling coils or beacons, and the fixed coding includes the line-block-section-specific data items.

3. The configuration according to claim 1, which further comprises radio transmitters disposed along the railroad line, and a radio coupling computer and a radio bus system connected between said at least one signal box and said radio transmitters.

4. The configuration according to claim 1, which further comprises a radio coupling computer disposed in said at least one signal box, and a radio bus system, said radio coupling computer, said radio bus system, and said rail vehicle radio receivers having a redundant construction.

5. The configuration according to claim 1, which further comprises a device, connected to said rail vehicle device radio computer, for automatic operation (ATO—Automatic Train Operation).

* * * * *